US008390186B2

(12) United States Patent
Yang et al.

(10) Patent No.: US 8,390,186 B2
(45) Date of Patent: Mar. 5, 2013

(54) FIELD EMISSION PLANAR LIGHTING LAMP

(75) Inventors: Tzung-Han Yang, Taipei (TW); Chi-Tsung Lo, Taipei (TW)

(73) Assignee: Tatung Company (TW)

( * ) Notice: Subject to any disclaimer, the term of this patent is extended or adjusted under 35 U.S.C. 154(b) by 0 days.

(21) Appl. No.: 13/064,742

(22) Filed: Apr. 13, 2011

(65) Prior Publication Data

US 2012/0153811 A1 Jun. 21, 2012

(30) Foreign Application Priority Data

Dec. 16, 2010 (TW) ..... 99144216 A

(51) Int. Cl.
*H01J 1/62* (2006.01)

(52) U.S. Cl. ..... 313/497; 313/495; 313/496; 445/23

(58) Field of Classification Search ..... 313/495–497; 445/23

See application file for complete search history.

(56) References Cited

U.S. PATENT DOCUMENTS

| | | | | |
|---|---|---|---|---|
| 6,445,122 | B1 | 9/2002 | Chuang et al. | |
| 6,541,906 | B2 * | 4/2003 | Lee et al. | 313/495 |
| 7,525,244 | B2 * | 4/2009 | Chung et al. | 313/491 |
| 7,598,665 | B2 * | 10/2009 | Li et al. | 313/495 |
| 7,830,078 | B2 * | 11/2010 | Lin et al. | 313/495 |
| 2007/0085462 | A1 * | 4/2007 | Jeon | 313/310 |

FOREIGN PATENT DOCUMENTS

| | | |
|---|---|---|
| CN | 1959503 | 5/2007 |
| TW | I256155 | 6/2006 |
| TW | I281684 | 5/2007 |
| TW | I304507 | 7/2007 |

* cited by examiner

*Primary Examiner* — Tracie Y Green
(74) *Attorney, Agent, or Firm* — Bacon & Thomas, PLLC

(57) ABSTRACT

The present invention relates to a field emission planar lighting lamp, which comprises: a base substrate; cathodes disposed on the base substrate; anodes disposed on the base substrate, wherein the cathodes are disposed beside the anodes, each anode has an impacted surface corresponding to the cathodes, and the impacted surface is an inclined plane or a curved plane; a phosphor layer disposed on the impacted surface of the anode; and a front substrate corresponding to the base substrate, wherein the anodes and the cathodes are disposed between the base substrate and the front substrate.

9 Claims, 6 Drawing Sheets

FIELD EMISSION PLANAR LIGHTING LAMP

CROSS REFERENCE TO RELATED APPLICATION

This application claims the benefits of the Taiwan Patent Application Serial Number 99143700, filed on Dec. 16, 2010, the subject matter of which is incorporated herein by reference.

BACKGROUND OF THE INVENTION

1. Field of the Invention

The present invention relates to a field emission planar lighting lamp and, more particularly, to a field emission planar lighting lamp with improved light utilization efficiency.

2. Description of Related Art

Field emission lighting lamps have advantages of simple structures, high brightness, and power saving, and can meet the requirements of flatness and large area. Hence, field emission lighting lamps are considered having potential for the displacement of fluorescent lamps.

FIG. 1 is a perspective view showing the operation principle of a conventional field emission lighting lamp. As shown in FIG. 1, the conventional field emission lighting lamp comprises: a cathode electrode 12, an electron emissive layer 14, an anode electrode 15, a phosphor layer 16, a front substrate 17, and a base substrate 11. The anode electrode 15 and the phosphor layer 16 are disposed on the front substrate 17, and the cathode electrode 12 and the electron emissive layer 14 are disposed on the base substrate 11. Hence, when a voltage is applied between the cathode electrode 12 and the anode electrode 15, an electric field is formed between the cathode electrode 12 and the anode electrode 15 to induce a tunnel effect. When the tunnel effect occurs, electrons release from the electron emissive layer 14, and the voltage applied on the anode electrode 15 accelerates the released electrons. Then, the accelerated electrons strike the phosphor layer 16 to excite the phosphor emitting light.

According to the conventional field emission lighting lamp, the front substrate 17 is generally a transparent glass substrate, and the material of the anode electrode 15 is a transparent conductive material such as ITO. Hence, when electrodes strike the phosphor layer 16, the light emitting from the phosphor layer 16 has to sequentially penetrate through the phosphor layer 16, the anode electrode 15, and the front substrate 17 to transmit to the outside. However, the electrons usually only strike the phosphor on the surface 161 of the phosphor layer 16, so the highest luminous efficiency would be found around the surface 161 of the phosphor layer 16. Hence, most of the light emitted from the phosphor layer 16 is restricted within the device and cannot be transmitted to the outside. In addition, partial light emitted from the surface 161 of the phosphor layer 16 may be absorbed by the phosphor layer 16, and partial reflective light cannot penetrate through the phosphor layer 16, the anode electrode 15, and the front substrate 17 to transmit outward. Therefore, the light extraction efficiency may further be reduced. Hence, the aforementioned conventional field emission lighting lamp generally has the disadvantage of low luminous efficiency.

SUMMARY OF THE INVENTION

The object of the present invention is to provide a field emission planar lighting lamp, which has improved light extraction efficiency.

To achieve the object, the field emission planar lighting lamp comprises: a base substrate; at least one cathode disposed on the base substrate; at least one anode disposed on the base substrate, wherein the cathode is disposed beside the anode, each anode has at least one impacted surface corresponding to the cathode, and the impacted surface is an inclined plane or a curved plane; at least one phosphor layer, wherein each phosphor layer is respectively disposed on the impacted surface of the anode; and a front substrate disposed over the base substrate, wherein the front substrate corresponds to the base substrate, and the anode and the cathode are disposed between the base substrate and the front substrate.

According to the field emission planar lighting lamp of the present invention, the cathode, the anode, and the phosphor layer are disposed on the base substrate. In addition, the front substrate serving as a light-emitting surface is disposed on a side facing to a surface of the phosphor layer, which shows high luminous efficiency. However, according to the conventional field emission planar lighting lamp, the light-emitting surface is located on the bottom of the phosphor layer, so the light-emitting surface is in an opposite position to the surface of the phosphor layer. Hence, the light emitted from the phosphor layer of the field emission planar lighting lamp of the present invention only has to penetrate through the front surface, and does not have to penetrate through the anode and the phosphor layer, compared to the conventional field emission planar lighting lamp. Therefore, the field emission planar lighting lamp of the present invention can shows improved luminous efficiency.

Preferably, the field emission planar lighting lamp of the present invention comprises m strips of cathodes, and n strips of anodes, each of m and n is an integer of 1 or more, and n is m+1. In addition, the cathodes and the anodes are parallel, and alternately disposed on the base substrate. More specifically, one cathode is disposed between two anodes. Hence, electrons released from a cathode can simultaneously strike the impacted surfaces of two anodes, which are disposed beside the cathode.

In addition, the field emission planar lighting lamp of the present invention may further comprise: support units disposed between the base substrate and the front substrate. Hence, a predetermined distance between the base substrate and the front substrate can be maintained by the support units. In addition, a region formed between the base substrate and the front substrate is in vacuum. Furthermore, the front substrate of the field emission planar lighting lamp of the present invention can be any light transparent substrate. Preferably, the material of the front substrate is soda-lime glass, soda glass, boron glass, leaded glass, quartz glass, or alkali-free glass. In addition, the base substrate can be an insulating substrate, such as ceramic substrate or glass substrate.

According to the field emission planar lighting lamp of the present invention, the cathode and the anode are in a strip-shape. In addition, the cross-section of the anode is triangle, trapezoid, semicircle, or arch, and a basal area of the anode is larger than a top area thereof. Preferably, the longitudinal-section area of each anode progressively increases from the top to the bottom thereof. In addition, the height of the anode may be higher than that of the cathode. Furthermore, the phosphor layer can be only disposed on the impacted surface of the anode, so there is no phosphor layer disposed on the top of the anode, which does not correspond to the cathode. In the present invention, the basal area of the anode means the area of the bottom of the anode facing to the base substrate, and the top area of the anode means the area of the top of the anode facing to the front substrate. In addition, the cross-section of the anode means a section perpendicular to the axis of the anode in the strip-shape, and the longitudinal-section of the anode means a section parallel to the axis of the anode.

In addition, according to the field emission planar lighting lamp of the present invention, the impacted surface of the anode is made of a conductive material with light reflectivity, preferably. Hence, the light restricted inside the phosphor layer can be reflected by the impacted surface and transmit to the front substrate. Therefore, the light extraction efficiency of the device can further be improved.

According to one aspect of the present invention, each anode can be a strip-shaped body. Preferably, the strip-shaped body is made of a conductive material with light reflectivity, such as metal. Hence, the anode not only can be used as an electrode, but also can reflect light to increase the light extraction efficiency of the field emission planar lighting lamp.

According to another aspect of the present invention, each anode may respectively comprises a strip-shaped body, and a reflective layer disposed on the strip-shaped body, and the reflective layer is made of a conductive material with light reflectivity. In addition, the strip-shaped body can be a hollow body, or be made of a conductive material or a non-conductive material. Alternatively, the strip-shaped body and the base substrate are integrated with each other. In the present aspect, the reflective layer can be Al thin film, Au thin film, Ag thin film, or Sn thin film.

According to further another aspect of the present invention, the anode can be made of a metal plate, wherein the metal plate comprises at least one protrusion and at least one cathode arranged portion, each protrusion has at least one impacted surface, an insulating layer is disposed on a surface of the cathode arranged portion, and each cathode is correspondingly disposed on the insulating layer. Preferably, the metal plate can be made of any metal material capable of reflecting light, such as Al, Au, Ag, or Sn.

In addition, according to the field emission planar lighting lamp of the present invention, each cathode can respectively comprise a conductive protrusion and an electron emissive layer, and the electron emissive layer is disposed on a surface of the conductive protrusion. Herein, the material of the conductive protrusion is not particularly limited, and can be any conductive material generally used in the art. In addition, the shape of the conductive protrusion is also not particularly limited, and can be a rectangle or a cylinder. Furthermore, the material of the electron emissive layer is not particularly limited, and can be any electron emissive material generally used in the art. For example, the material of the electron emissive layer can be carbon material such as carbon nanotubes and carbon nanowires, or zinc oxide (ZnO).

Furthermore, according to the field emission planar lighting lamp of the present invention, the material of the phosphor layer is not particularly limited, and can be any fluorescent powders or phosphor powders generally used in the art. In addition, one or more kinds of fluorescent powders or phosphor powders, which emit different colors, can be mixed to use in the phosphor layer. Therefore, when the phosphor layer is excited, UV light, infrared light, white light or other lights with different wavelengths can be emitted from the phosphor layer.

Other objects, advantages, and novel features of the invention will become more apparent from the following detailed description when taken in conjunction with the accompanying drawings.

DETAILED DESCRIPTION OF THE PREFERRED EMBODIMENT

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

Embodiment 1

Figure 1:
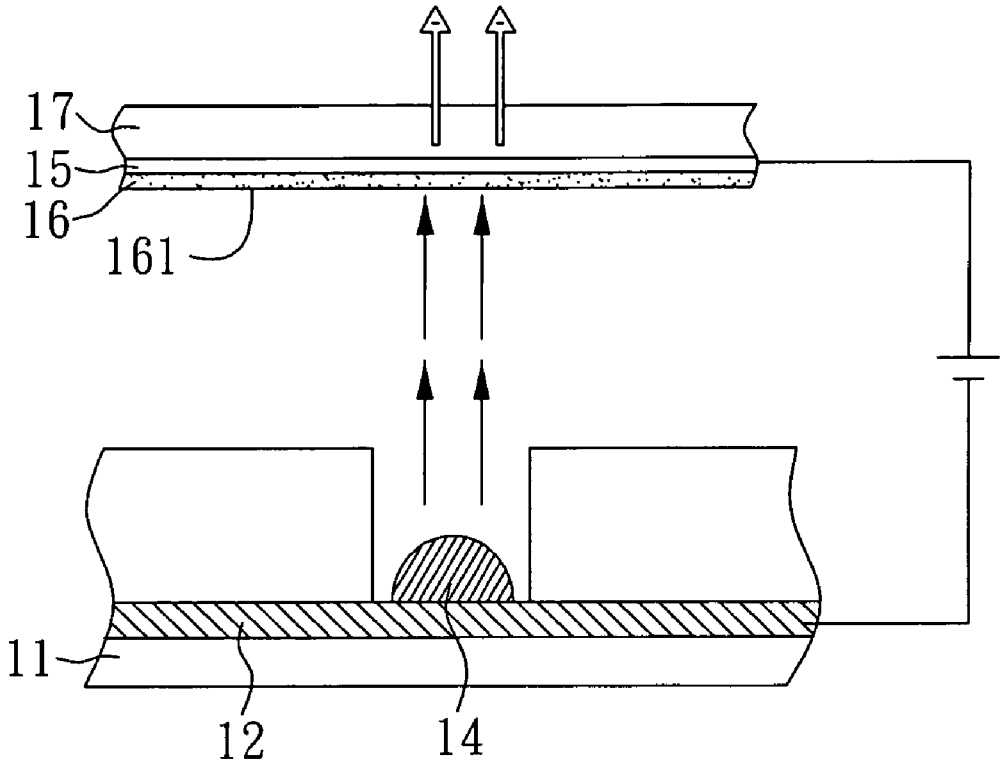
FIG. 1(PRIOR ART)
FIG. 1 is a perspective view showing the operation principle of a conventional field emission planar lighting lamp.
Figure 2A:
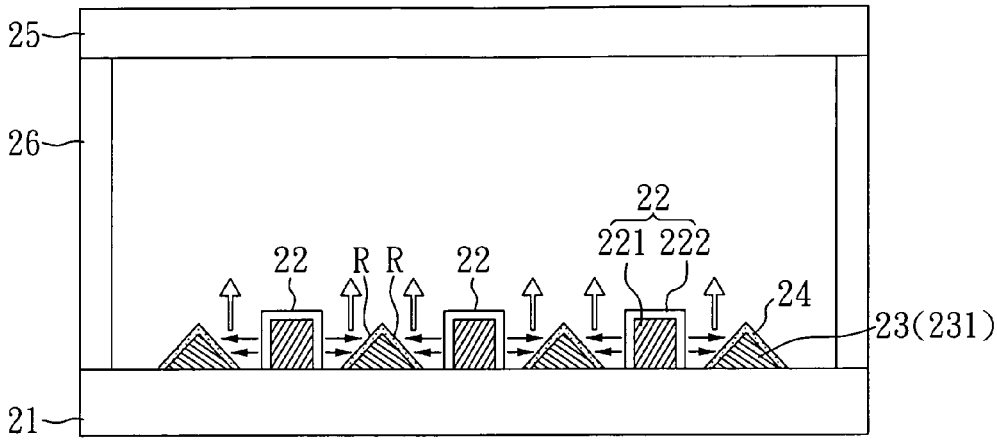
FIG. 2A is a cross-sectional view showing a field emission planar lighting lamp according to Embodiment 1 of the present invention.

As shown in FIG. 2A, the field emission planar lighting lamp of the present embodiment comprises: a base substrate 21, cathodes 22, anodes 23, phosphor layers 24, a front substrate 25, and support units 26. Herein, the front substrate 25 served as a light-emitting surface corresponds to the base substrate 21, and locates on the side facing to a surface of the phosphor layer 24, which shows high luminous efficiency. In addition, the support units 26 are disposed between the base substrate 21 and the front substrate 25, and the region between the base substrate 21 and the front substrate 25 maintains in vacuum. Furthermore, the cathodes 22, the anodes 23, and the phosphor layers 24 are disposed on the base substrate 21, and located between the base substrate 21 and the front substrate 25.

Compared to the conventional field emission planar lighting lamp that the light-emitting surface is located on the bottom of the phosphor layer (i.e. the light-emitting surface is in an opposite position to the surface of the phosphor layer), the field emission planar lighting lamp of the present embodiment shows improved luminous efficiency. In addition, according to the field emission planar lighting lamp of the present embodiment, the light within the phosphor layer 24 can be reflected by the impacted surfaces R of the anodes 23, and transmit to the front substrate 25. Therefore, the light extraction efficiency of the field emission planar lighting lamp of the present embodiment can further be improved.

Figure 2B:
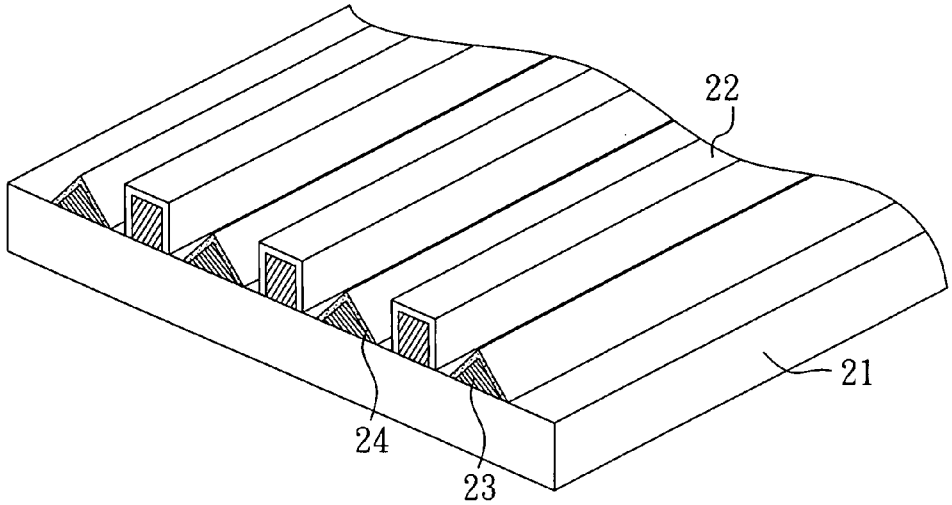
FIG. 2B is a perspective view showing the arrangement of cathodes and anodes of a field emission planar lighting lamp according to Embodiment 1 of the present invention.

As shown in FIG. 2A and FIG. 2B, the field emission planar lighting lamp of the present embodiment comprises three cathodes 22 and four anodes 23, and the cathodes 22 and the anodes 23 are in strip-shapes. In addition, the anodes 23 are disposed beside the cathodes 22, the impacted surfaces R of the anodes 23 correspond to cathodes 22, and the phosphor layers 24 are disposed on the impacted surfaces R of the anodes 23. Furthermore, the cathodes 22 and the anodes 23 are parallel and alternately disposed on the base substrate 21. Hence, one cathode 22 is disposed between two adjacent anodes 23.

According to the field emission planar lighting lamp of the present embodiment, each cathode 22 respectively comprises a conductive protrusion 221 and an electron emissive layer 222, and the electron emissive layer 222 is disposed on a surface of the conductive protrusion 221. Hence, when electrons are released from the electron emissive layers 222 (signed as filled arrows), the released electrons can strike the phosphor layers 24 on the anodes 25 to emit light (signed as outlined arrows).

As shown in FIG. 2A, each anode 23 of the field emission planar lighting lamp of the present embodiment comprises a strip-shaped body 231 with a triangle cross-section, and the impacted surface R corresponding to the cathode 22 is an inclined plane. The phosphor layers are disposed on the impacted surfaces R of the anodes 23. In addition, the longitudinal-section area of each anode 23 progressively increases from the top to the bottom thereof. Hence, light emitted from the phosphor layer can transmit toward the front substrate 25 and emit to the outside (signed as outlined arrows).

In addition, the material of the strip-shaped bodies 231, which is used as the anodes 23, is a material capable of reflecting light. In the present embodiment, the material of the strip-shaped bodies 231 is Al. Hence, when the electrons released from the electron emissive layers 222 strike the phosphor layers 24 on the impacted surfaces R of the anodes 23, the impacted surfaces R of the anodes 23 can reflect the light emitted from the phosphor layers 24 toward the front substrate 25 disposed over the base substrate 21. Therefore, the light extraction efficiency of the field emission planar lighting lamp of the present embodiment can further be improved.

Embodiment 2

Figure 3:
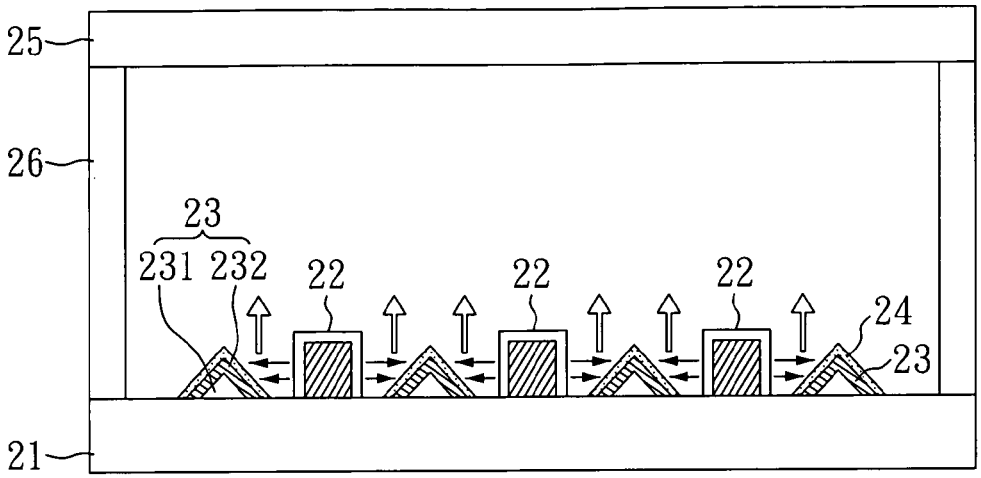
FIG. 3 is a cross-sectional view showing a field emission planar lighting lamp according to Embodiment 2 of the present invention.

The structure of the field emission planar lighting lamp of the present embodiment is similar to that of Embodiment 1, except that each anodes 23 of the present embodiment respectively comprises a strip-shaped body 231 and a reflective layer 232 disposed on the strip-shaped body 231, as shown in FIG. 3. In addition, the reflective layers 232 are made of a conductive material capable of reflecting light. In the present embodiment, the material of the reflective layers 232 is Al.

Embodiment 3

Figure 4:
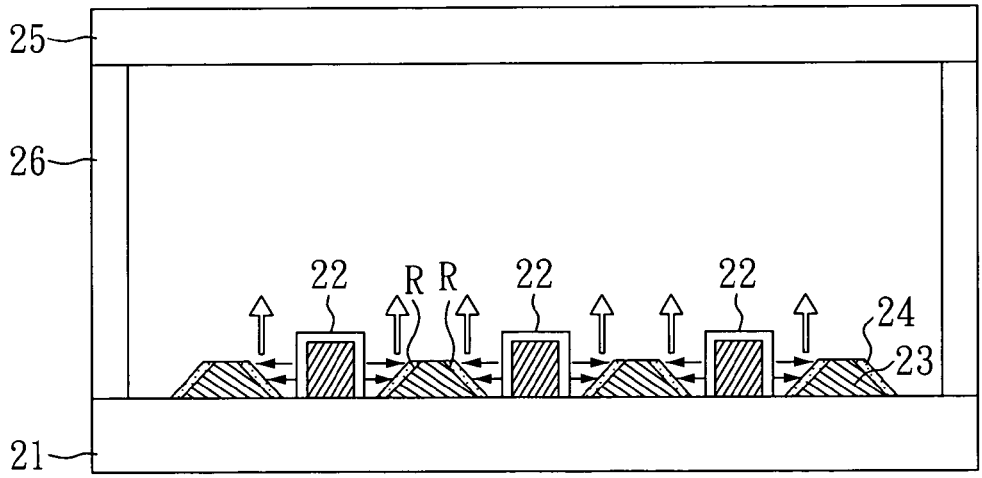
FIG. 4 is a cross-sectional view showing a field emission planar lighting lamp according to Embodiment 3 of the present invention.

The structure of the field emission planar lighting lamp of the present embodiment is similar to that of Embodiment 1, except that the cross-sections of the anodes 23 of the present embodiment are trapezoid, as shown in FIG. 4. In addition, the inclined side-planes of the anodes 23 are impacted surfaces R, and the phosphor layers 24 are disposed on the impacted surfaces R of the anodes 23.

Embodiment 4

Figure 5:
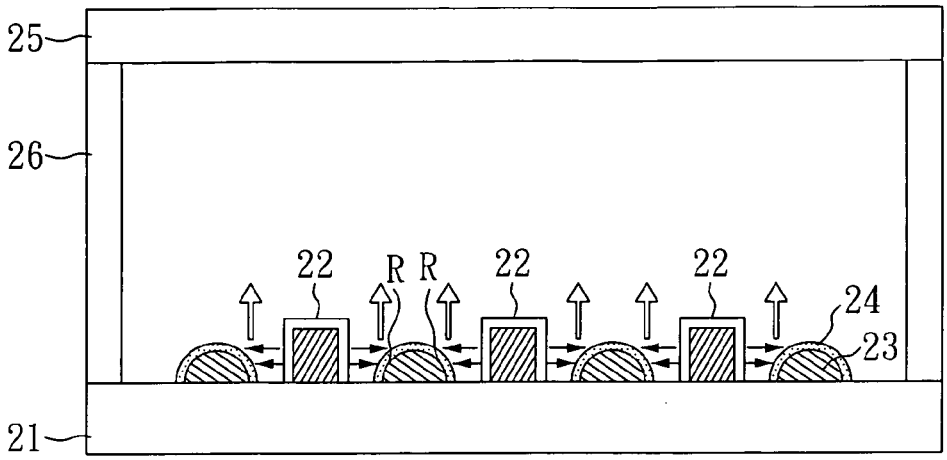
FIG. 5 is a cross-sectional view showing a field emission planar lighting lamp according to Embodiment 4 of the present invention.

The structure of the field emission planar lighting lamp of the present embodiment is similar to that of Embodiment 1, except that the cross-sections of the anodes 23 of the present embodiment are semicircle, as shown in FIG. 5. In addition, the curved side-planes of the anodes 23 are impacted surfaces R, and the phosphor layers 24 are disposed on the impacted surfaces R of the anodes 23.

Embodiment 5

Figure 6:
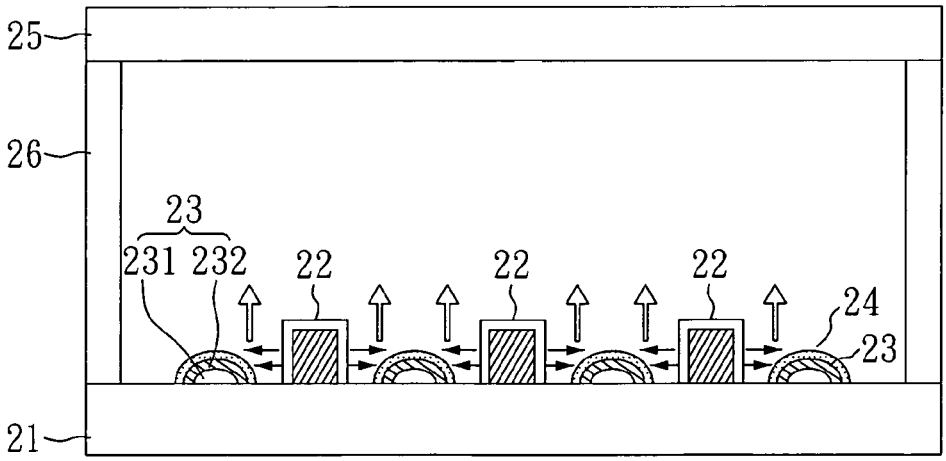
FIG. 6 is a cross-sectional view showing a field emission planar lighting lamp according to Embodiment 5 of the present invention.

The structure of the field emission planar lighting lamp of the present embodiment is similar to that of Embodiment 2, except that the strip-shaped bodies 231 of the anodes 23 of the present embodiment are hollow bodies, and the cross-sections of the strip-shaped bodies 231 are arch, as shown in FIG. 6.

Embodiment 6

Figure 7:
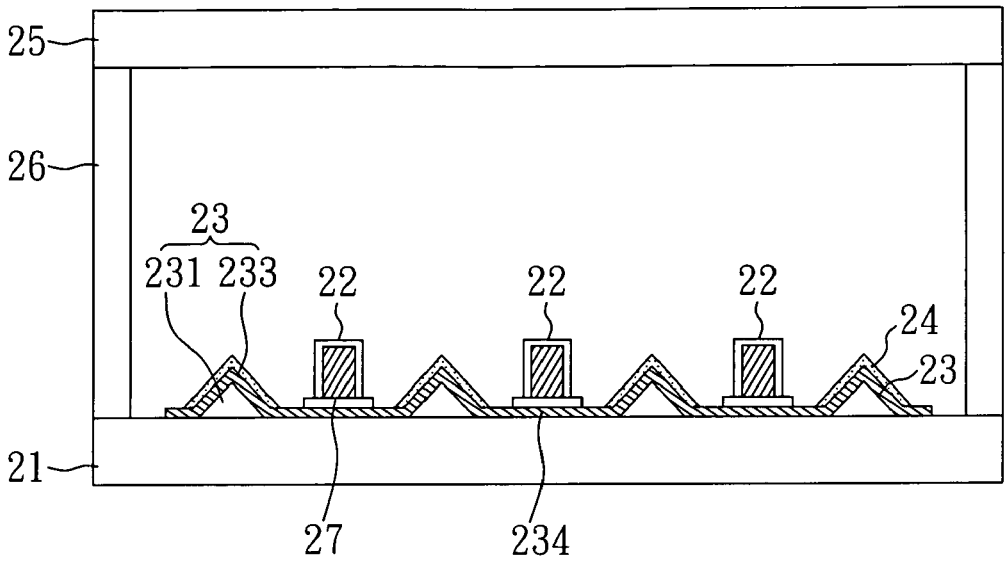
FIG. 7 is a cross-sectional view showing a field emission planar lighting lamp according to Embodiment 6 of the present invention.

The structure of the field emission planar lighting lamp of the present embodiment is similar to that of Embodiment 1, except that the anodes 23 of the present embodiment are made of a metal plate, as shown in FIG. 7. The metal plate comprises protrusions 233 and cathode arranged portions 234, and insulating layers 27 are disposed on the cathode arranged portions 234. In addition, each cathodes 22 is correspondingly disposed on the insulating layer 27. Furthermore, as shown in FIG. 7, the strip-shaped bodies 231 of the anodes 23 of the present invention are hollow bodies.

Embodiment 7

Figure 8:
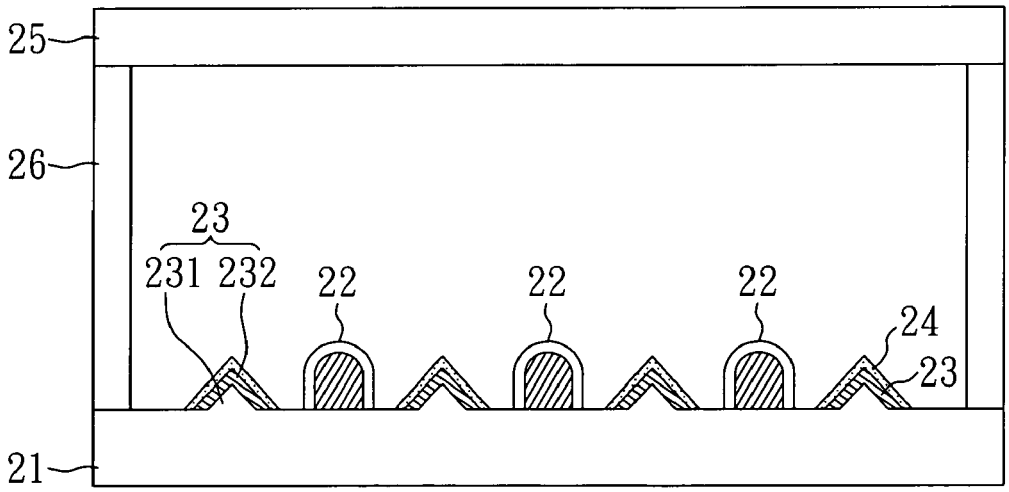
FIG. 8 is a cross-sectional view showing a field emission planar lighting lamp according to Embodiment 7 of the present invention.

The structure of the field emission planar lighting lamp of the present embodiment is similar to that of Embodiment 2, except that the strip-shaped bodies 231 of the anodes 23 and the base substrate 21 of the present embodiment are integrated with each other, as shown in FIG. 8.

Embodiment 8

Figure 9:
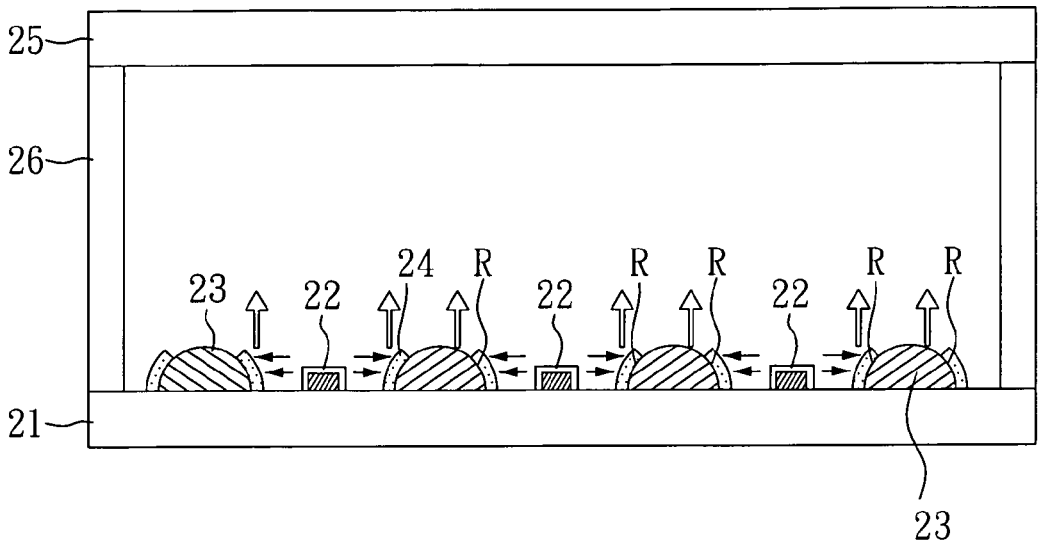
FIG. 9 is a cross-sectional view showing a field emission planar lighting lamp according to Embodiment 8 of the present invention.

The structure of the field emission planar lighting lamp of the present embodiment is similar to that of Embodiment 4, except that the height of the anodes is higher than that of the cathodes of the present embodiment, as shown in FIG. 9. In addition, the phosphor layers 24 are only disposed on the impacted surfaces R of the anodes 23, i.e. the phosphor layers 24 are not disposed on the tops of the anodes 23, which do not correspond to the cathodes 22.

Embodiment 9

Figure 10:
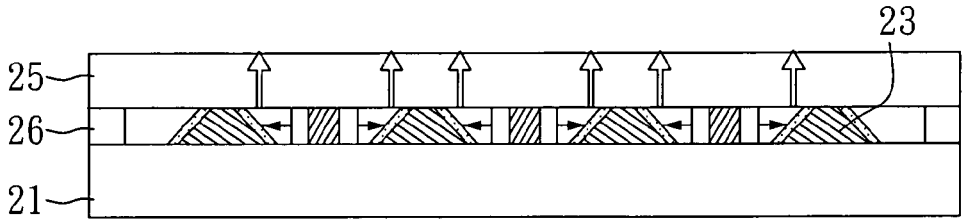
FIG. 10 is a cross-sectional view showing a field emission planar lighting lamp according to Embodiment 9 of the present invention.

The structure of the field emission planar lighting lamp of the present embodiment is similar to that of Embodiment 3, except that the tops of the anodes 23, that the phosphor layers 24 are not formed thereon, directly contact to the front substrate 25 in the present embodiment, as shown in FIG. 10. Hence, the anodes 23 can be used as support units between the base substrate 21 and the front substrate 25 at the same time.

Although the present invention has been explained in relation to its preferred embodiment, it is to be understood that many other possible modifications and variations can be made without departing from the spirit and scope of the invention as hereinafter claimed.

What is claimed is:

1. A field emission planar lighting lamp, comprising:

a base substrate;

at least one cathode disposed on the base substrate;

at least one anode disposed on the base substrate, wherein the anode has an inclined or curved impacted cross-sectional plane that corresponds to the cathode and a longitudinal section area of each anode progressively increases from top to bottom;

at least one phosphor layer respectively disposed on the impacted surface of the anode; and a front substrate disposed over the base substrate, wherein the front substrate corresponds to the base substrate, and the anode and the cathode are disposed between the base substrate and the front substrate.

2. The field emission planar lighting lamp as claimed in claim 1, wherein the at least one cathode and the at least one anode are alternately disposed on the base substrate.

3. The field emission planar lighting lamp as claimed in claim 2, wherein the field emission planar lighting lamp comprises m strips of cathodes, and n strips of anodes, each of m and n is an integer of 1 or more, and n is m+1.

4. The field emission planar lighting lamp as claimed in claim 1, wherein the cross-section of the anode is triangle, trapezoid, semicircle, or arch.

5. The field emission planar lighting lamp as claimed in claim 1, wherein the impacted surface of the anode is made of a conductive material with light reflectivity.

6. The field emission planar lighting lamp as claimed in claim 1, wherein each anode respectively comprises a strip-shaped body, and a reflective layer disposed on the strip-shaped body, and the reflective layer is made of a conductive material with light reflectivity.

7. The field emission planar lighting lamp as claimed in claim 6, wherein the strip-shaped body is integrated with the base substrate.

8. The field emission planar lighting lamp as claimed in claim 1, wherein the anode is made of a metal plate, the metal plate comprises at least one protrusion and at least one cathode arranged portion, each protrusion has at least one impacted surface, an insulating layer is disposed on a surface of the cathode arranged portion, and each cathode is correspondingly disposed on the insulating layer.

9. The field emission planar lighting lamp as claimed in claim 1, wherein each cathode respectively comprises a conductive protrusion and an electron emissive layer, and the electron emissive layer is disposed on a surface of the conductive protrusion.

* * * * *